US008337051B2

(12) United States Patent
Hawkes et al.

(10) Patent No.: US 8,337,051 B2
(45) Date of Patent: Dec. 25, 2012

(54) REFLECTOR ASSEMBLY AND METHOD OF MAKING SAME

(75) Inventors: Brien Hawkes, Wimberley, TX (US); Joseph Garcia, San Antonio, TX (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 701 days.

(21) Appl. No.: 12/392,478

(22) Filed: Feb. 25, 2009

(65) Prior Publication Data

US 2010/0214789 A1 Aug. 26, 2010

(51) Int. Cl.
*F21V 7/10* (2006.01)

(52) U.S. Cl. ..... 362/297; 362/296.05; 362/346; 362/347; 362/364

(58) Field of Classification Search ..... 362/296.01, 362/297, 296.05–296.08, 311.06–311.1, 362/341, 346–350, 279, 290, 321, 325, 364
See application file for complete search history.

(56) References Cited

U.S. PATENT DOCUMENTS

| | | | |
|---|---|---|---|
| 385,905 | A | 7/1888 | Cannon |
| 457,557 | A | 8/1891 | Cannon |
| 494,339 | A | 3/1893 | Marston |
| 1,032,907 | A | 7/1912 | Hyde |
| 2,960,950 | A | 11/1960 | Hart, Jr. |
| 3,258,948 | A | 7/1966 | Carlson, Sr. |
| 3,276,239 | A | 10/1966 | Achler et al. |
| 3,760,622 | A | 9/1973 | Mansell |
| 3,895,987 | A | 7/1975 | Loreck |
| 3,975,936 | A | 8/1976 | Baldwin et al. |
| 4,028,542 | A | 6/1977 | McReynolds, Jr. |
| 4,242,727 | A | 12/1980 | De Vos et al. |
| 4,293,900 | A | 10/1981 | Dziubaty |
| 4,413,500 | A | 11/1983 | Myer |
| 4,422,134 | A | 12/1983 | Brass |
| 4,424,727 | A | 1/1984 | Mader |
| 4,627,256 | A | 12/1986 | Myer |
| 4,643,016 | A | 2/1987 | Barberine et al. |
| 4,855,886 | A | 8/1989 | Eijkelenboom et al. |
| 4,926,673 | A | 5/1990 | Laurent et al. |
| 4,979,086 | A | 12/1990 | Heinisch |
| 5,016,458 | A | 5/1991 | De Smet |
| 5,067,336 | A | 11/1991 | De Smet |
| 5,454,378 | A | 10/1995 | Palmer et al. |
| 5,485,389 | A | 1/1996 | Terada et al. |
| 5,568,680 | A | 10/1996 | Parker |
| 5,571,280 | A * | 11/1996 | Lehrer ..... 362/352 |
| 5,690,422 | A | 11/1997 | Brass |
| 5,857,358 | A | 1/1999 | De Vries, Jr. et al. |
| 5,876,654 | A | 3/1999 | Blonigen et al. |
| 6,029,486 | A | 2/2000 | Haraga et al. |

(Continued)

FOREIGN PATENT DOCUMENTS

| | | |
|---|---|---|
| GB | 2208619 | 4/1989 |

*Primary Examiner* — Jong-Suk (James) Lee
*Assistant Examiner* — Leah S Macchiarolo

(57) ABSTRACT

A luminaire reflector assembly comprises a top pan having a light socket connected to one of an upper or lower surface of the top pan, the top pan having a plurality of spaced slits about the periphery of the top pan, a lower pan spaced from the top pan, the lower pan connected to the top pan by at least one strut, a plurality of reflective panels extending between the top pan and the lower pan, the plurality of reflective panels bent in a first direction by a punch and an elastomeric die pad, the plurality of reflective panels also bent in a second direction by the punch and elastomeric die pad.

7 Claims, 15 Drawing Sheets

U.S. PATENT DOCUMENTS

| | | | | |
|---|---|---|---|---|
| 6,151,938 | A | 11/2000 | Park et al. | |
| 6,152,579 | A | 11/2000 | Reed et al. | |
| 6,203,176 | B1 | 3/2001 | Gordin | |
| 6,233,989 | B1 | 5/2001 | Blinstubas | |
| 6,338,564 | B1 | 1/2002 | Jordan et al. | |
| 6,464,378 | B1 * | 10/2002 | Reed et al. | 362/320 |
| 6,783,261 | B2 | 8/2004 | Simon | |
| 7,213,948 | B2 | 5/2007 | Hein | |
| 7,445,363 | B2 | 11/2008 | Vanden Eynden | |
| 7,534,501 | B2 * | 5/2009 | Durney | 428/596 |
| 7,591,567 | B2 * | 9/2009 | Wilcox et al. | 362/297 |
| 7,784,976 | B2 * | 8/2010 | Chon | 362/297 |
| 2008/0084626 | A1 | 4/2008 | Blood | |

* cited by examiner

REFLECTOR ASSEMBLY AND METHOD OF MAKING SAME

CROSS-REFERENCE TO RELATED DOCUMENTS

None

TECHNICAL FIELD

This invention pertains to a luminaire reflector assembly. More specifically the invention pertains to a luminaire reflector assembly and method of making the same wherein said the reflector assembly includes three-dimensionally curved reflective panels.

BACKGROUND

In forming luminaire reflectors, there are several limitations. First, lighting designers prefer a reflector to approximate a desired curvature to the extent possible. In order to form such curvature in typical press brake manufacturing methods, the press brake must be utilized to form each bend in a separate step or "hit" process. Therefore where additional bends are desired to more closely approximate a curve, the manufacturing process becomes more lengthy and expensive.

Moreover, with press brake reflector forming procedures, the formation process may only be accurate to the nearest half degree. In applications where high accuracy is required, a higher degree of accuracy through less tolerance in manufacturing maybe required to produce a luminaire which performs in an acceptable manner.

Current luminaire reflectors utilize segments which are bent in two dimensions. Upon forming these in the press brake, as previously described, the reflectors are typically stacked in until an entire batch of reflectors is formed. As a result of stacking, the lowermost reflectors in the stack carry large loads which often bend these lower reflectors changing them from the "formed" configuration. It would be desirable if the reflectors were stronger without changing material or the desirable optical performance of the reflector.

Given the foregoing deficiencies, it would be desirable to form a luminaire reflector which is bent three dimensionally in a single action and overcomes the above and other deficiencies.

SUMMARY

A luminaire reflector assembly comprises a top pan having a light socket connected to one of an upper or lower surface of the top pan, the top pan having a plurality of spaced slits about the periphery of the top pan, a lower pan spaced from the top pan, the lower pan connected to the top pan by at least one strut, a plurality of reflective panels extending between the top pan and the lower pan, the plurality of reflective panels bent in a first direction by a punch and an elastomeric die pad, the plurality of reflective panels also bent in a second direction by the punch and elastomeric die pad. The luminaire reflector assembly wherein each of the plurality of reflective panels having at least one tab disposed at an upper end. The luminaire reflector assembly further comprising a flange disposed at a bottom end of said reflective panels. The luminaire reflector assembly wherein the at least one tab extends through the slot of the top pan. The luminaire reflector assembly wherein the flanges engage the bottom pan. The luminaire reflector assembly wherein the plurality of reflective panels further comprises a tab at a first end and a flange at a second end, said tab engaging one of the top pan and the bottom pan and the flange engaging the other of the top pan and the bottom pan. The luminaire reflector assembly wherein the plurality of reflective panels have at least one corner group disposed adjacent the at least one strut. The luminaire reflector assembly wherein the plurality of reflective panels includes a central group disposed between the struts. The luminaire reflector assembly wherein the plurality of reflective panels being free of visible bend lines along an inner surface.

A luminaire reflector assembly, comprises a bottom pan, a top pan spaced from the bottom pan, a plurality of reflector panels extending between the top pan and the bottom pan, a number of the plurality of reflector panels defining a reflector, the plurality of reflector panels being curved in three dimensions including a first curvature along a horizontal plane and a second curvature along a vertical plane wherein the plurality of reflective panels are curved three dimensionally by a punch and an elastomeric die pad. The reflector assembly wherein the reflector panels further comprise a tab extending from one of the upper end or the lower end of the reflector panels. The reflector assembly wherein the reflector panels further comprise a flange extending from the other of the upper end or the lower end of the reflector panels. The reflector assembly further comprises a lamp aperture in central area of the top pan. The reflector assembly further comprises a plurality of struts extending between the top pan and the bottom pan.

A reflector assembly comprises a top pan, a bottom pan spaced from the top pan, the bottom pan having an aperture disposed therein, the aperture having peripheral stepped regions, a plurality of reflectors panels extending between the top and bottom pans, the plurality of reflectors panels defining at least one reflector, each of the plurality of reflector panels having a first curvature along a horizontal plane and a second curvature along a vertical plane, the reflector panels disposed at varying distances from a centerline of the bottom pan due to the stepped regions within the bottom pan.

A method of manufacturing a luminaire reflector panel comprises the steps of cutting a blank to a preselected shape, placing the blank on a deformable elastomeric pad, the blank disposed between the pad and a male tool, pressing the male tool into the blank and elastic pad, and, forming a first curvature in the blank and a second curvature in the blank with the male tool so that the blank is bent three-dimensionally, positioning the formed blank to define the reflector.

A method of manufacturing a luminaire reflector panel comprises the steps of placing a reflective blank on a deformable elastomeric pad, the reflective blank disposed between the pad and a male punch, the male punch being having three dimensional curvature on a side facing the reflective blank, forcing the male tool into the reflective blank, forming the three dimensional curvature in the reflective blank, cutting the three-dimensionally curved reflective blank into a desired shape, positioning the reflective blank to define the reflector. The method wherein the reflective blank defines a reflector panel. The method further comprises the step of positioning the reflector panel between a top pan and a bottom pan. The method further comprises the step of forming multiple reflector panels. The method further comprises the step of positioning multiple reflector panels to define a complete luminaire reflector.

BRIEF DESCRIPTION OF THE ILLUSTRATIONS

Embodiments of the invention are illustrated in the following illustrations.

DETAILED DESCRIPTION

Figure 1:
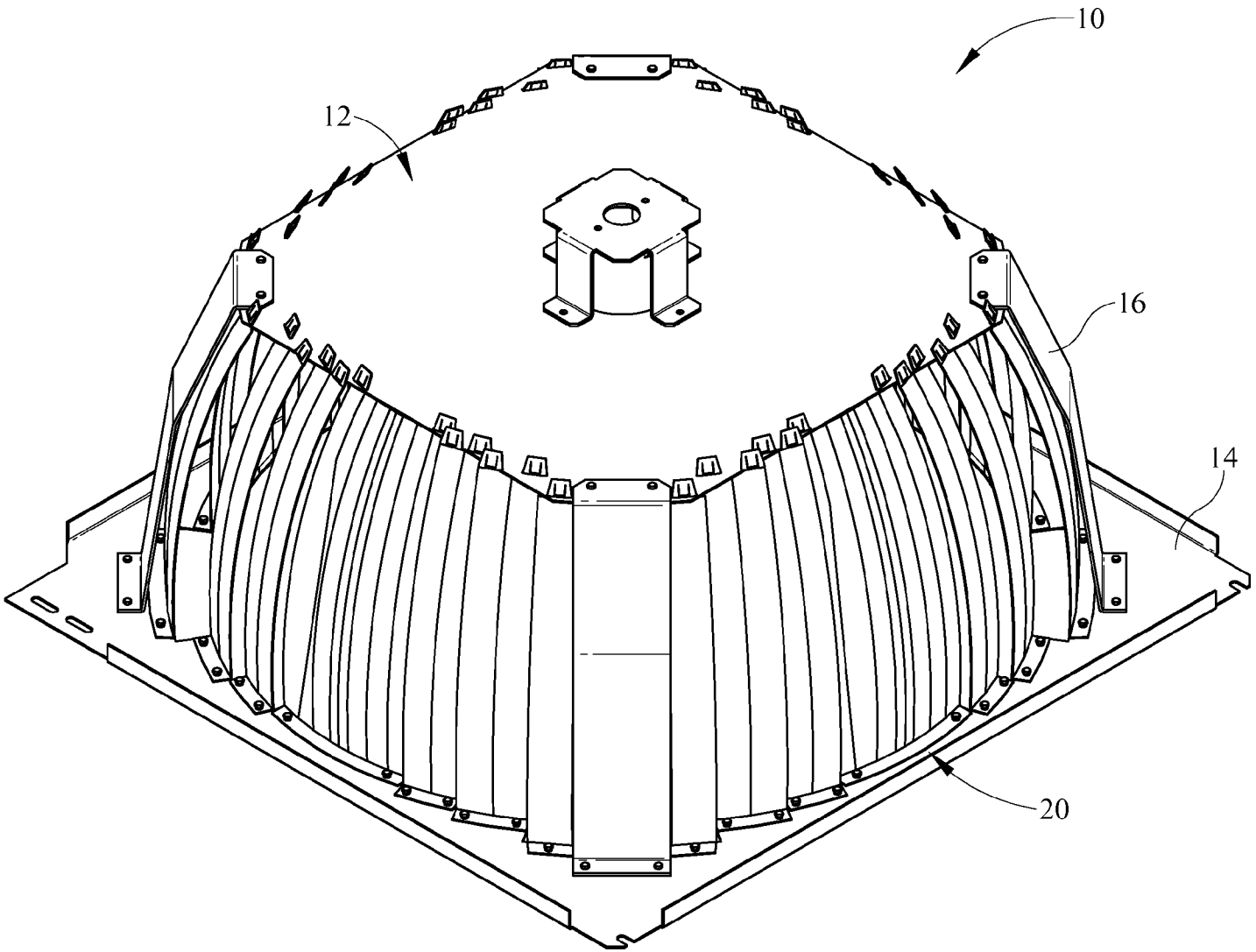
FIG. 1 is an upper perspective view of the reflector assembly.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are generally shown in FIGS. 1-15 a luminaire reflector assembly and method of making same. The instant luminaire reflector assembly comprises a reflector assembly having a plurality of reflector panels. The reflector panels are formed in a process utilizing a single tool and an opposed elastomeric material in a single processing step to form a three-dimensionally curved reflector panel. The three-dimensionally curved panels are formed in a stepped arrangement varying the distance from the centerline of the lamp to provide an optically desirable light output.

Referring initially to FIG. 1, a perspective view of the luminaire reflector assembly 10 is depicted. The reflector assembly 10 comprises a top pan 12 and a bottom pan 14 spaced apart from one another. The top pan and bottom pan 12, 14 are generally parallel in arrangement relative to one another. Extending between the top pan and bottom pan 12, 14 is a reflector 20 formed of a plurality of three dimensionally curved reflective panels, described further herein. Also extending between each of the top pan and bottom pan 12, 14 are struts 16 which maintain spacing between the top pan 12 and bottom pan 14. With the reflector 20 removed, or before the reflector 20 is positioned between the top pan 12 and bottom pan 14, the struts 16 retain the top pan 12 and bottom pan 14 together.

As shown in the assembled view, the reflector 20 is engaged at the top by the top pan 12 and at the bottom by the bottom pan 14. The reflector 20 is generally circular, in a horizontal plane, in shape and with a varying radius through a vertical plane. Therefore the reflector 20, defined by the plurality of panels, for example panels 60,70, 80 of FIGS. 4-6, which are each generally cup shaped, extends between the top pan 12 and bottom pan 14.

Figure 2:
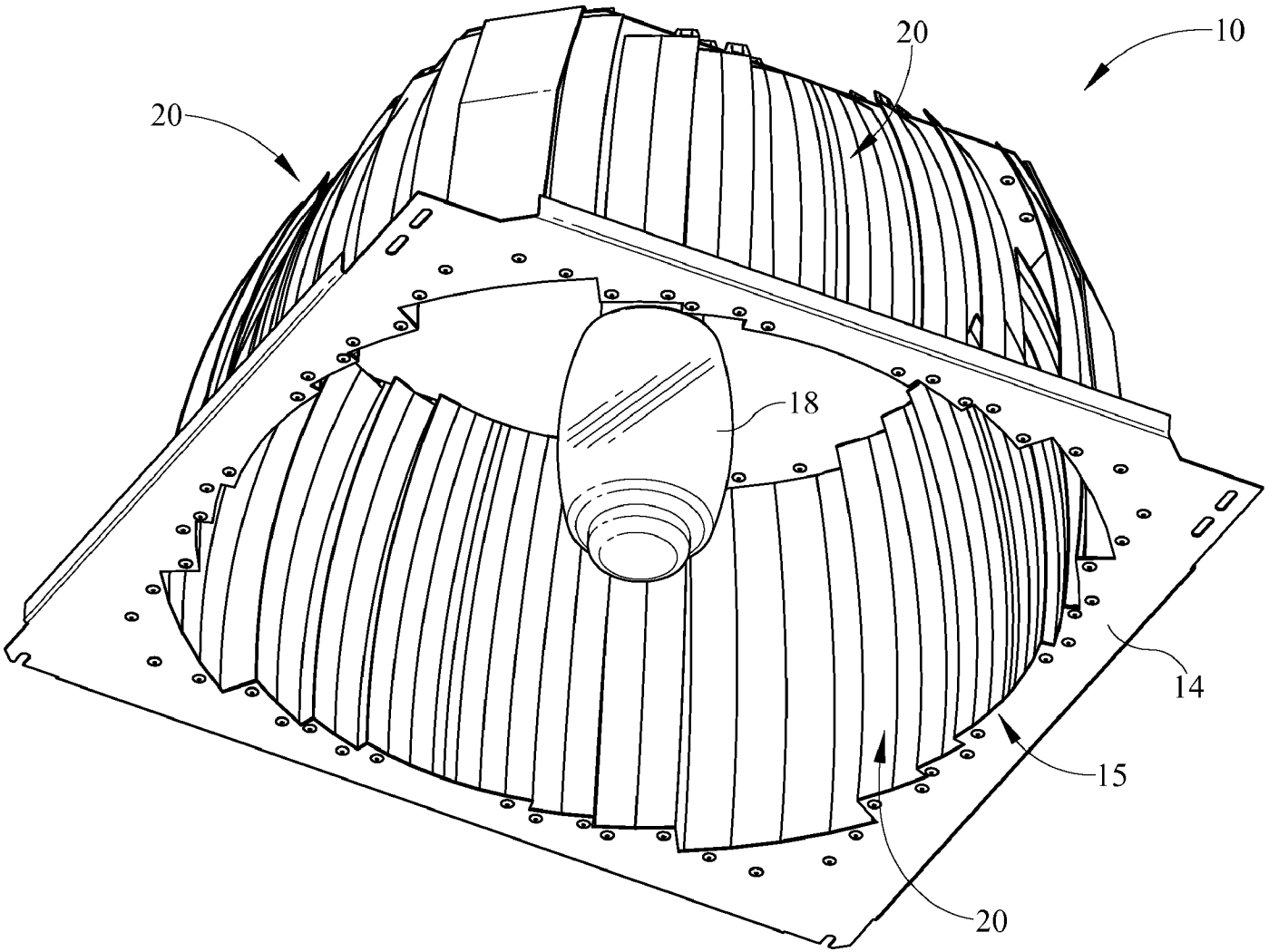
FIG. 2 is a lower perspective view of the reflector assembly of FIG. 1.

Referring now to FIG. 2, a lower perspective view of the reflector assembly 10 is depicted. On the inside of the reflector assembly 10 is a lamp 18. The exemplary lamp 18 is a high intensity discharge (HID) lamp, however alternative lighting sources may by utilized with the reflector assembly 10, and therefore are well within the scope of the instant disclosure.

The panels of reflector 20 depend from the top pan 12 (FIG. 1) to the bottom pan 14. The bottom pan 14 comprises an opening 15 which is generally circular in shape. The opening 15 includes steps 90 (FIG. 8) defined by variation in the radial distance from the periphery of the opening to the center line C of the lamp 18. The lower end of the panels of reflector 20 are positioned at various distances from the center of the vertical centerline extending through the lamp 18. Thus, one skilled in the art will realize that the reflector 20, defined by cup shaped reflector panels, has a varying radius in a vertical plane or direction and in a single horizontal plane at the bottom pan 14.

Figure 3:
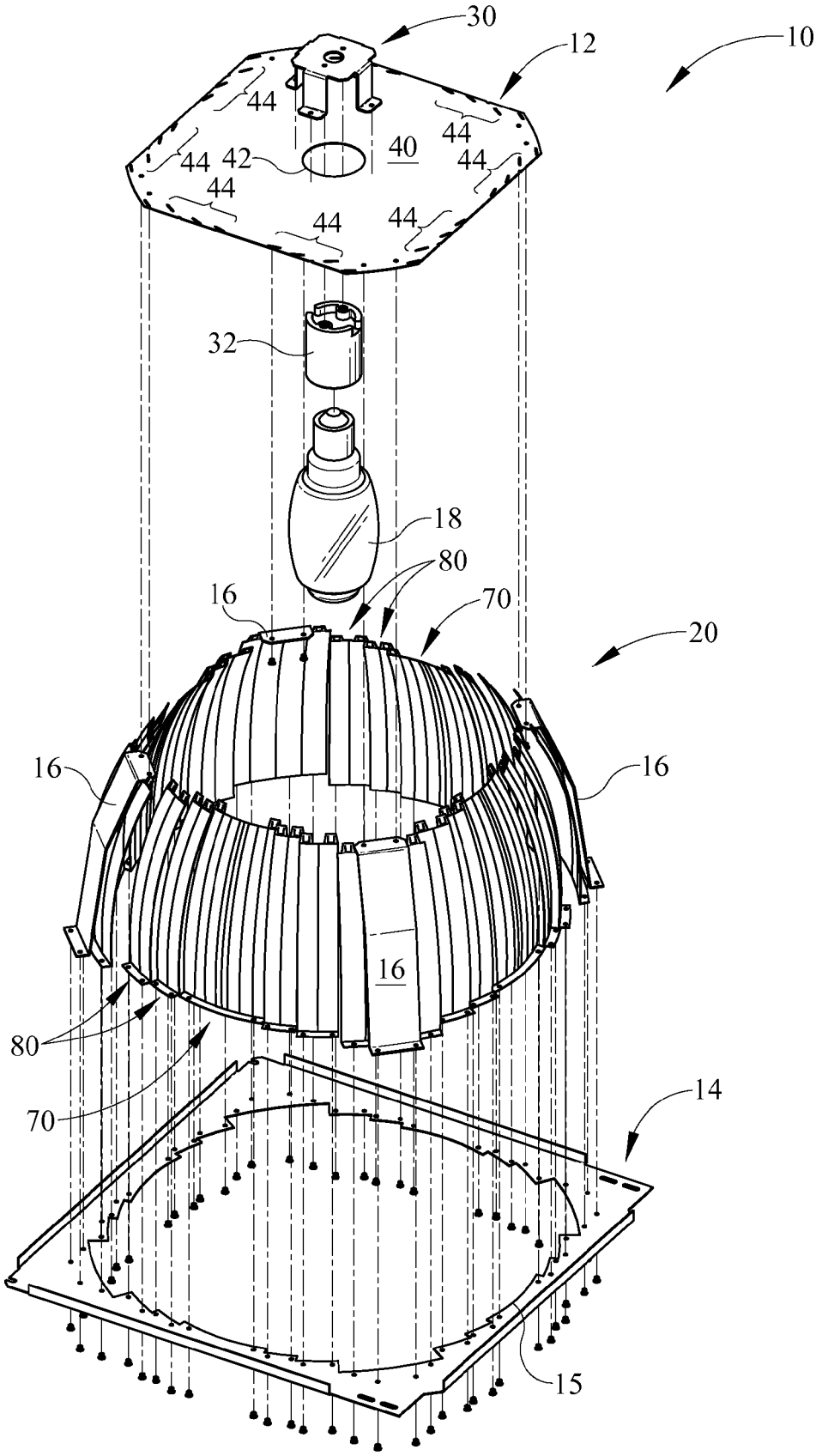
FIG. 3 is an exploded perspective view of the reflector assembly of FIG. 1.

Referring now to FIG. 3, the reflector assembly 10 is shown in exploded perspective view. Above the top pan 12 is a socket retaining member 30. The socket retaining member 30 is disposed on upper surface 40 of the top pan 12. The socket retaining member 30 of the instant embodiment is retained on the upper surface 40 by one or more fasteners (not shown). The socket 32 extends through a central opening 42 in the top pan 12. Alternatively, the socket 32 may be disposed above or through the aperture or opening 42 or alternatively may be disposed beneath the top pan 12, depending on the method of installation of the socket 32 and the desired location of the lamp 18. The top pan 12 further comprises a plurality of slits 44 extending about the periphery of the structure. The lamp 18 is aligned with the socket 32 for positioning therein once the socket 32 is connected to the socket retaining member 30.

Beneath the top pan 12 is the reflector 20. A plurality of reflective panels define the reflector 20, and each of the panels extend between the top pan 12 and the bottom pan 14. Each of the reflective panels is curved in three dimensions. This curvature is obtained through the use of a tool disposed on one side of the reflector panel and an elastomeric pad disposed on the opposite side of the reflector panel during a manufacturing process. The three dimension bending occurs with a single pressing action of the tool against a blank which eventually is formed into each reflector panel. The three dimensional bending of the reflective panels provides a highly desirable output for the reflector assembly 10 and the luminaire as a whole. Additionally, the three-dimensional bending provides a stronger shape for supporting the load of a plurality of stacked reflector panels. Thus the three dimensionally curved reflector panel is resistant to bending from the weight of the reflectors stacked above.

Beneath the reflector 20 is a bottom pan 14. The bottom pan 14 is generally square in shape, although alternative shapes may be utilized. The bottom pan 14 further comprises an opening 15 for light output. The lower light output opening 15 is generally circular in shape with steps of varying radius along the inner edge of the opening. Although, the output opening 15 comprises areas of varying radius, this is an exemplary embodiment and the steps may not necessarily be included in order to properly form the instant invention.

Figure 4:
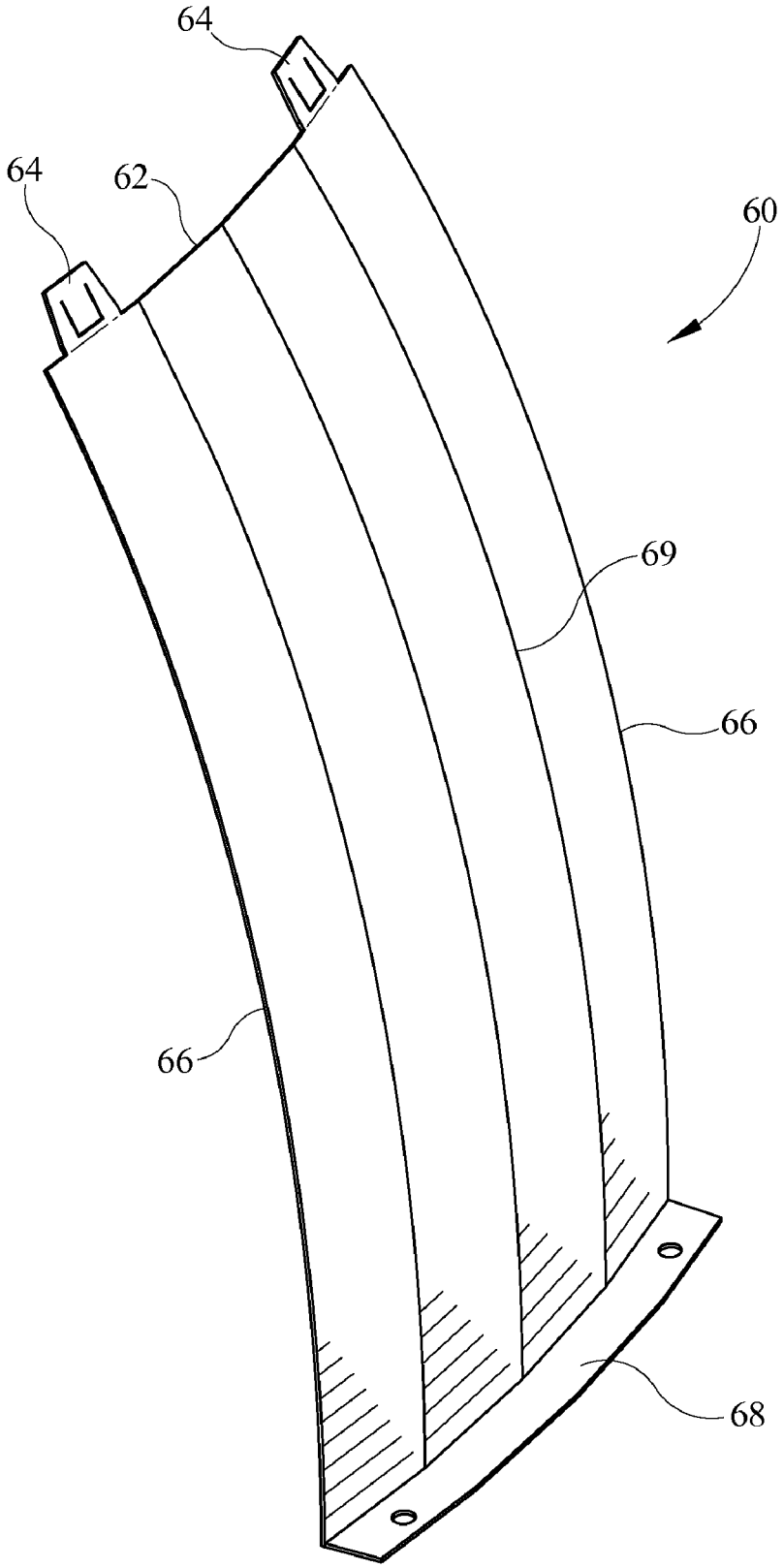
FIG. 4 is a perspective view of a corner reflector element.
Figure 5:
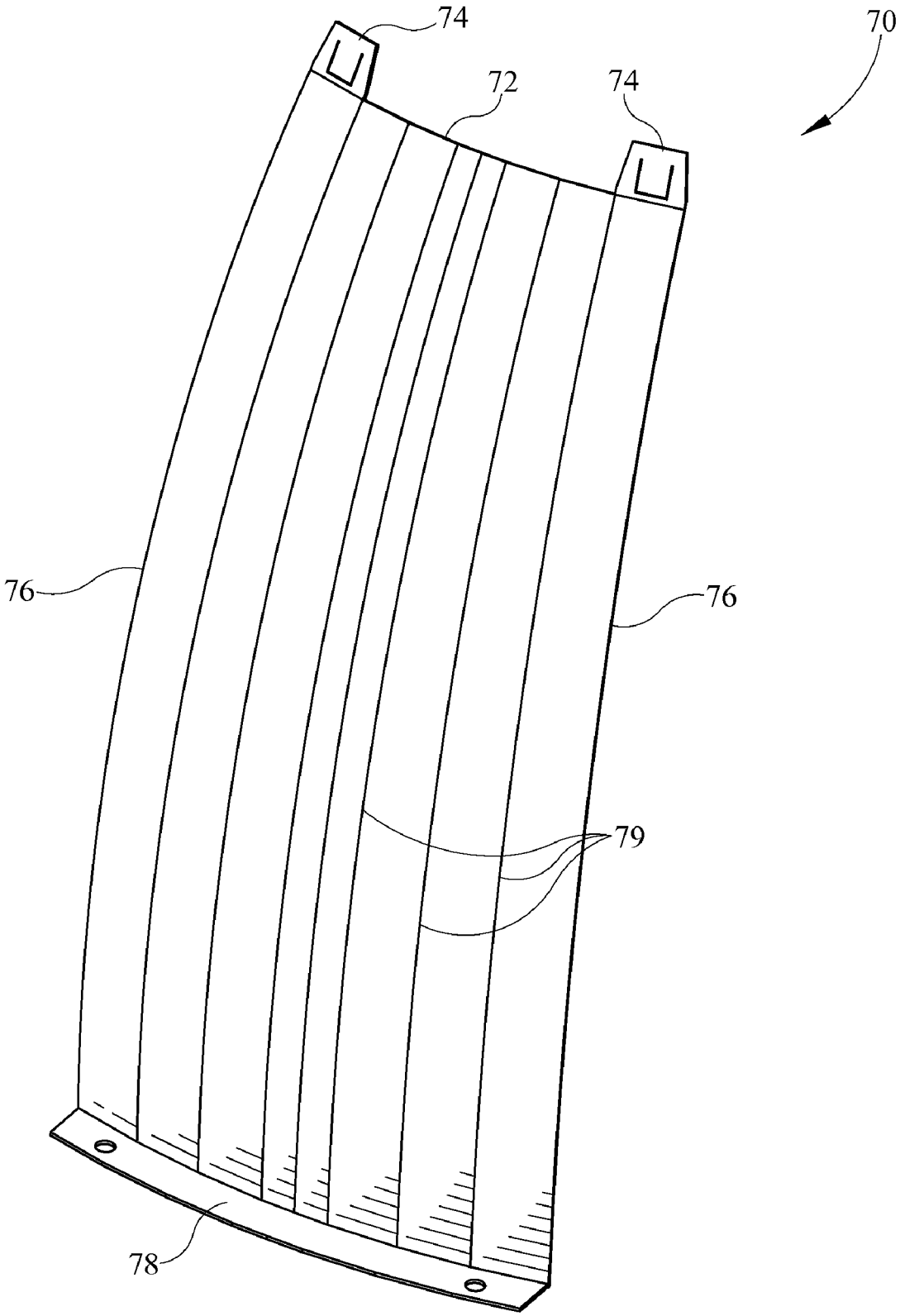
FIG. 5 is a perspective view of a central reflector element.
Figure 6:
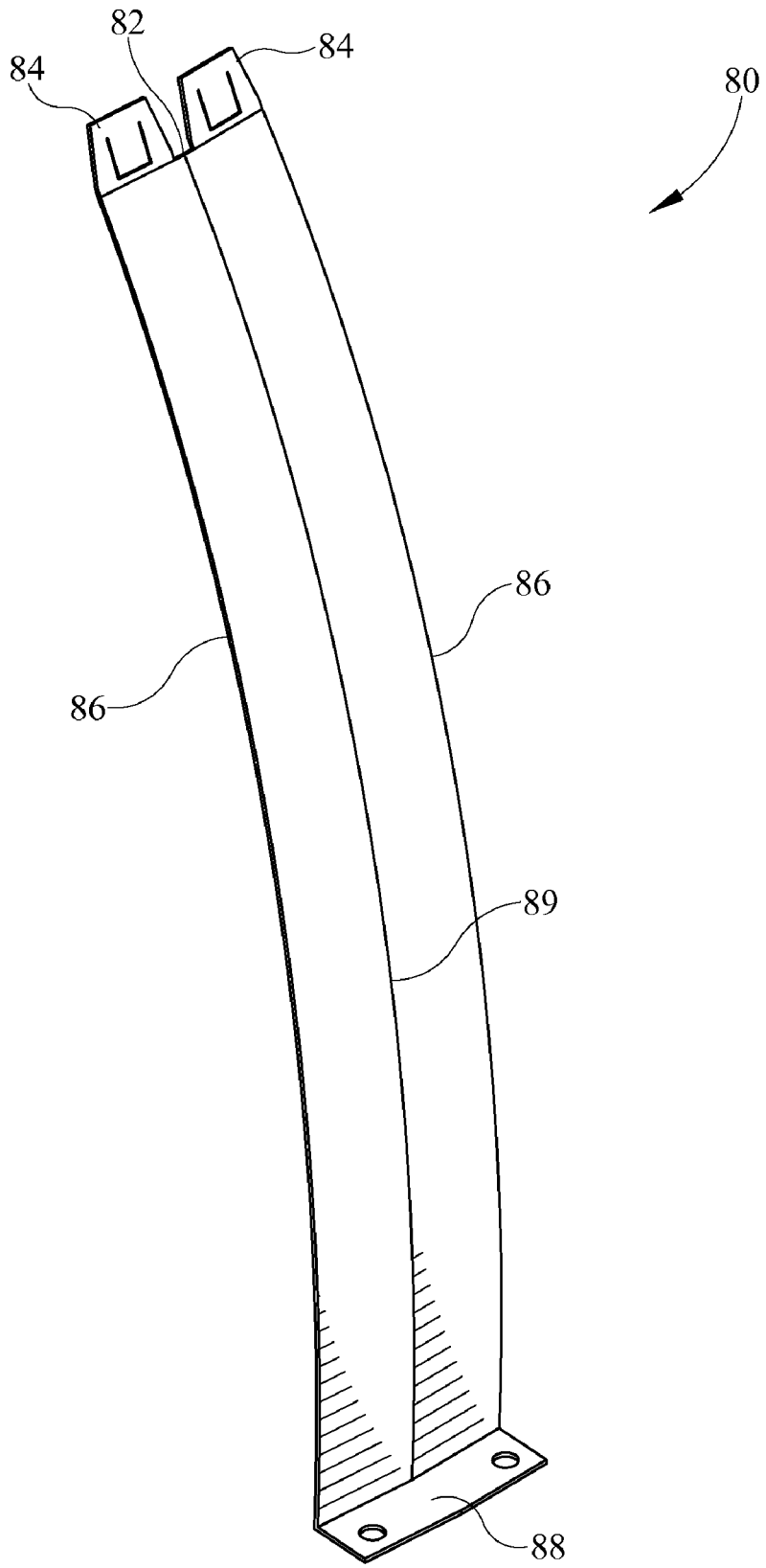
FIG. 6 is a perspective view of an intermediate reflector element of the reflector assembly embodiment of FIG. 1.

Referring now to FIGS. 4, 5 and 6, various reflector panels 60, 70, 80 defining the reflector 20 are depicted in perspective view. Referring initially to FIG. 4, a corner reflector panel 60 is shown in perspective view. The corner reflector panel 60 comprises an upper edge 62 having at least one tab 64. In the exemplary embodiment, first and second tabs 64 extend substantially upwardly from the upper edge 62. Two side edges 66 depend downwardly from the upper edge 62 to a lower edge having a flange 68. The upper tabs 64 pass through the slits 44 in the top pan 12 and the lower flange 68 engages the bottom pan 14 for fastening. However, other forms of fastening or affixing the reflector panel 60 to the top pan and bottom pan 12, 14 may be utilized. The corner reflector panel 60 is curved about a substantially vertical plane from the top edge 62 to the flange 68. Additionally, the corner reflector panel 60 bends about a horizontal plane from the first side edge to the second side edge 66. Thus the panel 60 curves three dimensionally.

Referring again briefly to FIG. 3, the corner reflector panel 60 is positioned adjacent each of the struts 16. As seen near the reflector lower opening 15, the corner areas of the bottom pan 14 receive the corner reflector panels 60. The corner reflector panels 60 are positioned radially further from the center of the opening 15 than the other reflector panels 70, 80 of the reflector 20. This provides a desirable light output. The corner reflector panels 60 are not stepped necessarily outwardly however. The design provides that a rounded shaped reflector is positioned within a bottom pan 14 of preselected shape. So in actuality the corner panels 60 approximate a rounded shape and the remaining panels are spaced inwardly due to the size and shape limitations of the bottom pan 14.

Referring again to FIG. 4, the corner reflector panel 60 further comprises a plurality of bend lines 69 extending between the upper edge 62 and the flange 68. The bend lines 69 are created by the shape of the tool described further herein. The bend lines 69 are exemplary and the reflector panel 60 may alternatively be curved more smoothly without the indication of any bend lines 69 therein.

At the upper end of the corner reflector panel 60, the tabs 64 extend through the slits 44 in the top pan 12. Once the tabs 64 pass through the slits 44 near the corner area of the top pan 12, the portion of the tab 64 above the top pan 12 may be bent to secure the panel 60 to the top pan 12. In an alternative combination, a flange 68 may be located at the top of the panel 60 and the tabs 64 may be relocated to along the bottom edge. However, these constructions are merely exemplary and alternative structures, devices and means may be utilized to connect the corner reflector panel 60 to the top pan 12 and bottom pan 14.

Referring now to FIG. 5, a central reflector panel 70. The reflector panel 70 is positioned, referring additionally to FIG. 3, between the struts 16 and the corner reflector panels 60 at a central location there between. The central reflector panel 70 comprises an upper edge 72 having first and second tabs 74 extending therefrom. Similar to the corner reflector panels 60, the upper tabs 74 extend through the top pan 12 and may be bent to retain the reflector panel 70 in place. Alternatively, the panel 70 may be welded to the top pan 12 at the upper end 72. At the opposite lower end of the central reflector panel is a lower flange 78 which is fastened to the bottom pan 14. The central reflector panel 70 bends about a vertical plane from the top edge 72 to the bottom flange 78. The panel 70 also bends from a first side edge 76 to an opposed second side edge 76. Accordingly the reflector panel 70 bends in three dimensions. This three dimensional bend is also formed by a male tool and an elastomeric die structure which causes the panel 70 to form to the shape of the male tool.

The central reflector panel 70 also comprises a plurality of bend lines 79 extending from the upper edge 72 toward to the flange 78. This is an exemplary embodiment however. Alternatively, the reflector panel 70 may be formed so that bend lines may not be visible to provide smooth curvature for the three dimensionally curved panel 70. Additionally, the reflector panel 70 is generally wider from side edge 76 to opposite side edge 76 than the corner reflector panel 60.

Referring now to FIG. 6, an intermediate reflector panel 80 is depicted in perspective view. Similar to the previous panels 60, 70 the intermediate panel 80 has an upper edge 82 and a lower flange 88. Extending from the upper edge 82 are first and second tabs 84. The intermediate panel 80 is also defined by side edges 86 extending between the upper edge 82 and the flange 88. The intermediate panel 80 is curved from the upper edge 82 to the flange 88 about a vertical plane. The panel 80 is also curved about a horizontal plane from first side edge 86 to opposite side edge 86. Similar to the reflector panels 60, 70, the panel 80 is also formed by a single press structure including a male tool on a first side and an elastomeric pad on the opposite side of the reflector panel 80.

Each of the reflective panels 60, 70, 80 are formed of reflective lighting sheet. Such reflective lighting sheet may be an aluminum sheet or a pre-paint material.

Figure 7:
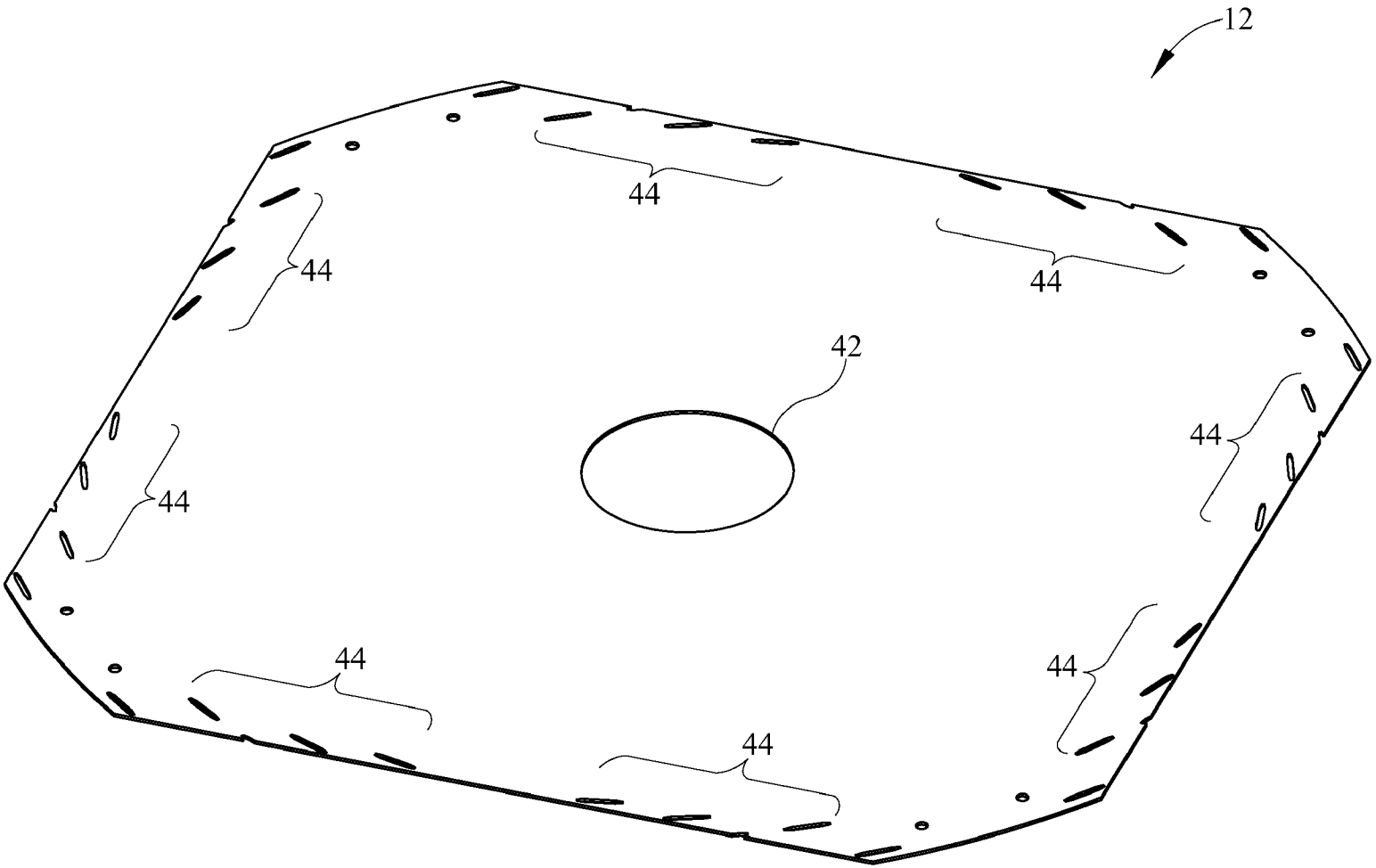
FIG. 7 is a perspective view of a top pan element of the reflector assembly embodiment of FIG. 1.

Referring now to FIG. 7, the top pan 12 is shown removed from the reflector assembly 10 in perspective view. The top pan 12 is generally rectangular in shape with the corners removed. However, alternative shapes may be utilized depending on the overall shape of the reflector. The top pan 12 comprises a plurality of slots 44. The central area of the top pan 12 comprises an aperture 42 through which the socket 32 may be positioned.

The top pan 12 further comprises a plurality of slots 44 which receive the tabs 64,74,84 of the reflector 20. Along the right hand edge of the top pan 12, the slots 44 are described for positioning of the various reflector panels 60, 70, 80. The two most central slots 44 receive the tabs 74 of the central reflector panel 70. The central panel 70 is given this name due to its central position along each edge of the top pan 12. The two slots 44 in each corner receive the tabs 64 of the corner reflector panels 60. The two remaining slots 44 between the corner slots 44 and the central slots 44 receive the intermediate reflector panel tabs 84. As best shown in FIG. 1, the intermediate reflector panels 80 may only utilize one slot 44, so that the second tab 84 is positioned on the outer edge of the top pan 12.

Figure 8:
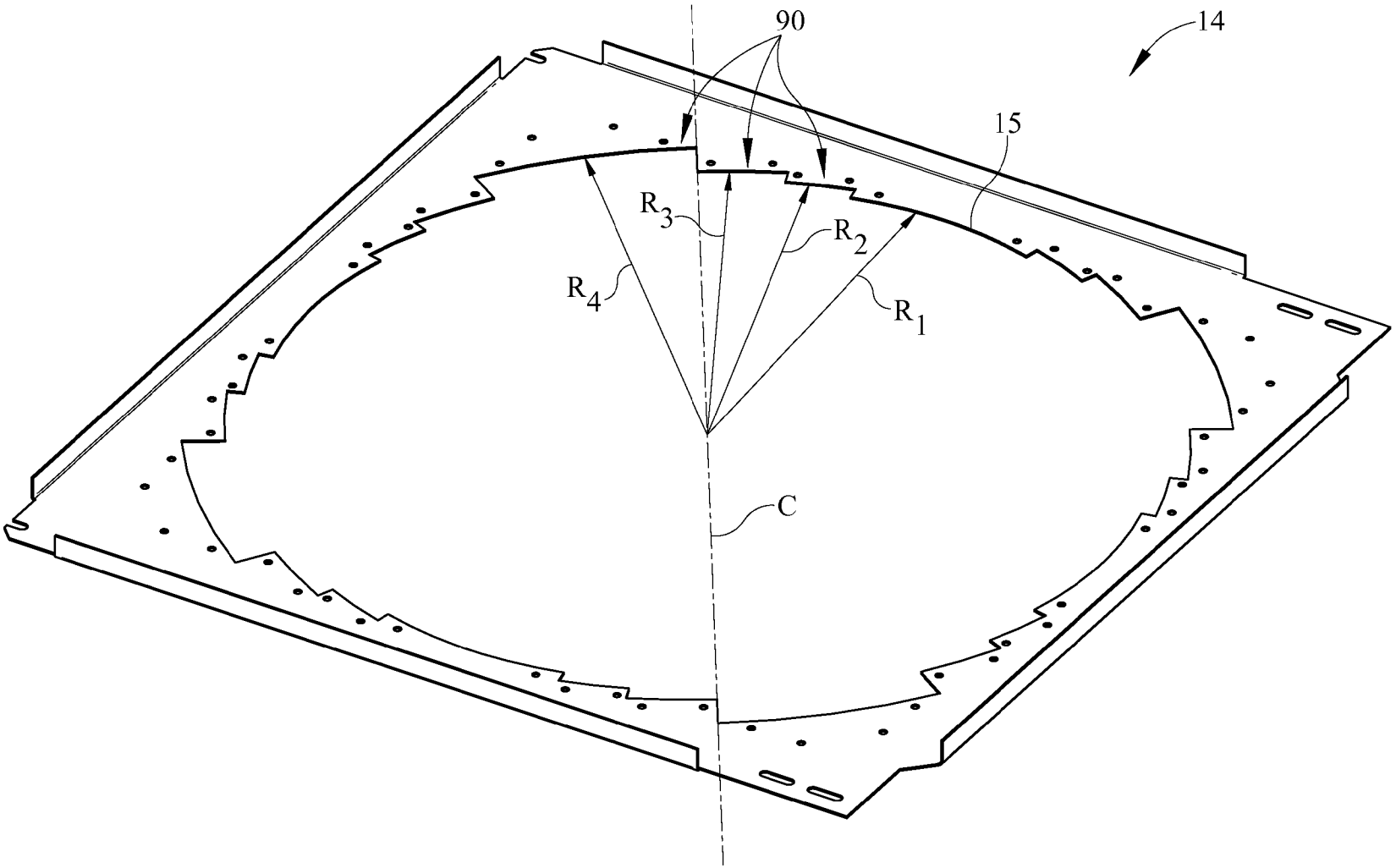
FIG. 8 is a perspective view of a bottom pan element of the reflector assembly embodiment of FIG. 1.
Figure 9:
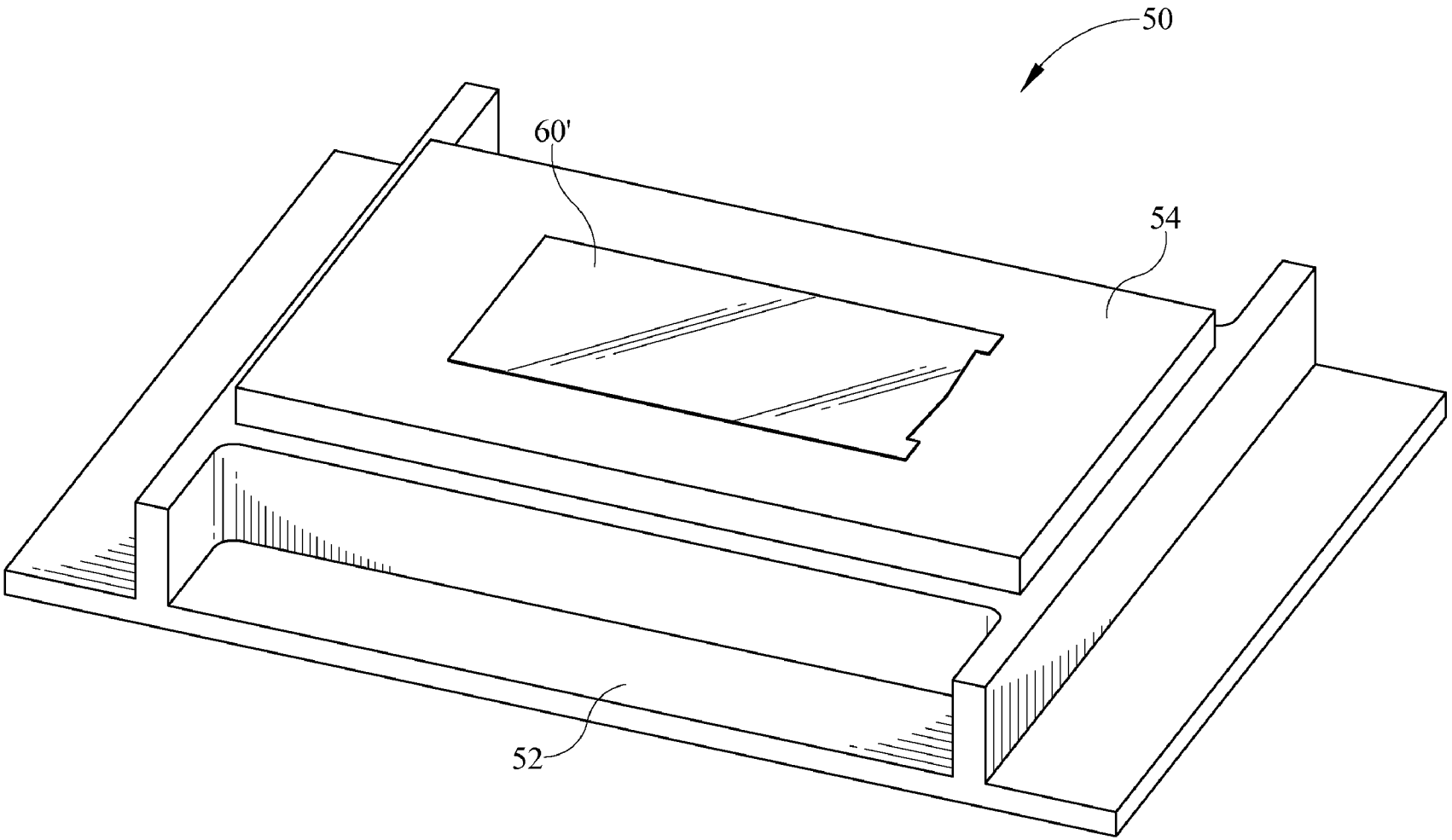
FIG. 9 is a perspective view of an exemplary initial process step in the formation of the reflector element.

Referring to FIG. 8, the bottom pan 14 is shown in perspective view. The bottom pan 14 is generally flat and square in shape, although other shapes may be utilized, having an aperture 15 generally formed in the central location of the pan 14. The aperture 15 is generally circular in shape with stepped portions 90 defining the aperture and varying the radial distance from the center of the aperture to the edge thereof. The figure depicts various radial arrows extending from a centerline C to the edge of the aperture 15. The first radial line R1 extends to the center portion of the aperture edge where the central reflector panel 70 is positioned. R1 is the shortest radial distance from the center line C to the aperture edge 15. The radial distance R2 represents a stepped distance from the edge R1. In this position an intermediate reflector panel 80 may be positioned at a distance R2 from the center line. Similarly, at a distance R3 from the centerline C, a second intermediate reflector panel 80 may be positioned. The radial distance R3 is greater than radial distance R2.

A corner reflector panel 60 is positioned at a distance R4 on the bottom pan 14. As clearly seen from the figure, the radial distance R4 is greater than radial distance R3. These four panels represent generally one-eighth of the reflector 20 circumference. The remaining space about the bottom pan 14 is filled in similarly as described with the different reflector portions. In this design, the reflector panels 60, 70, 80 are spaced various radial distances from the center line of the aperture 50 to provide a desirable light output Referring now to FIG. 9, a perspective view of a partial tooling assembly 50 is shown. The assembly includes a base 52 wherein an elastomeric pad 54 is disposed. The base 52 may be of various forms, shapes and materials. For example, the exemplary base 52 is formed of angle iron structures to define a bed wherein the elastomeric pad 54 is positioned. Positioned on an upper surface of the elastomeric pad 54 is a reflector blank, for example 60', which will be formed into the reflector panel, for example 60. Although an exemplary blank 60' is shown, the blank may be any of the blanks utilized in forming the reflector panels 60, 70, 80.

Figure 10:
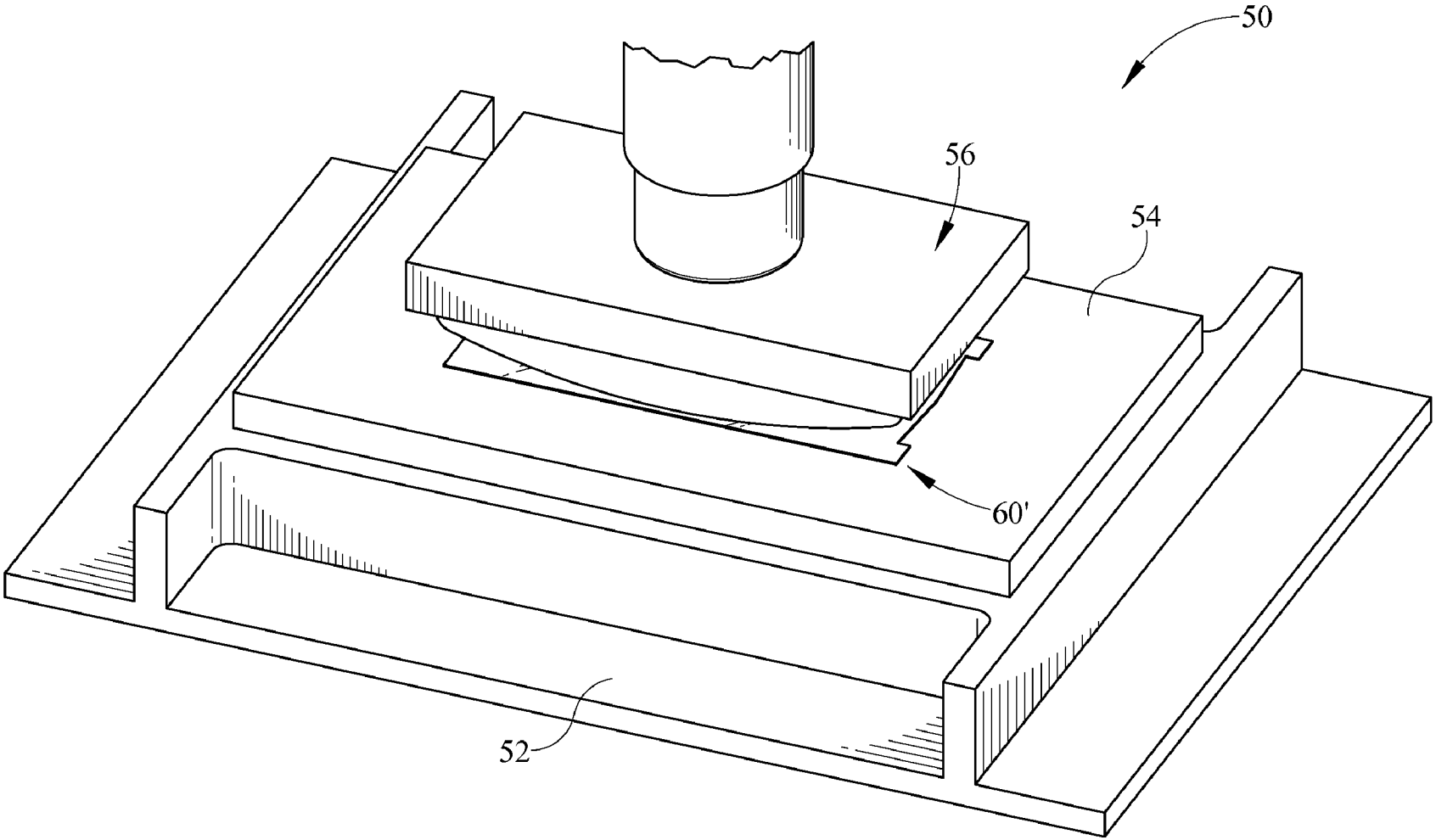
FIG. 10 is a perspective view of an exemplary second process step in the formation of the reflector element.

Referring now to FIG. 10, a tool 56 is shown moving toward the blank 60' and beginning minimal engagement therewith. The tool 56 has a three-dimensionally curved lower surface 57 corresponding to the desired shape of the reflector panel, for example one of either panel 60, 70, or 80. As the tool 56 moves into engagement with the blank 60', the downward force of the tool 56 begins to cause three-dimensional bending of the reflector blank 60'.

Figure 11:
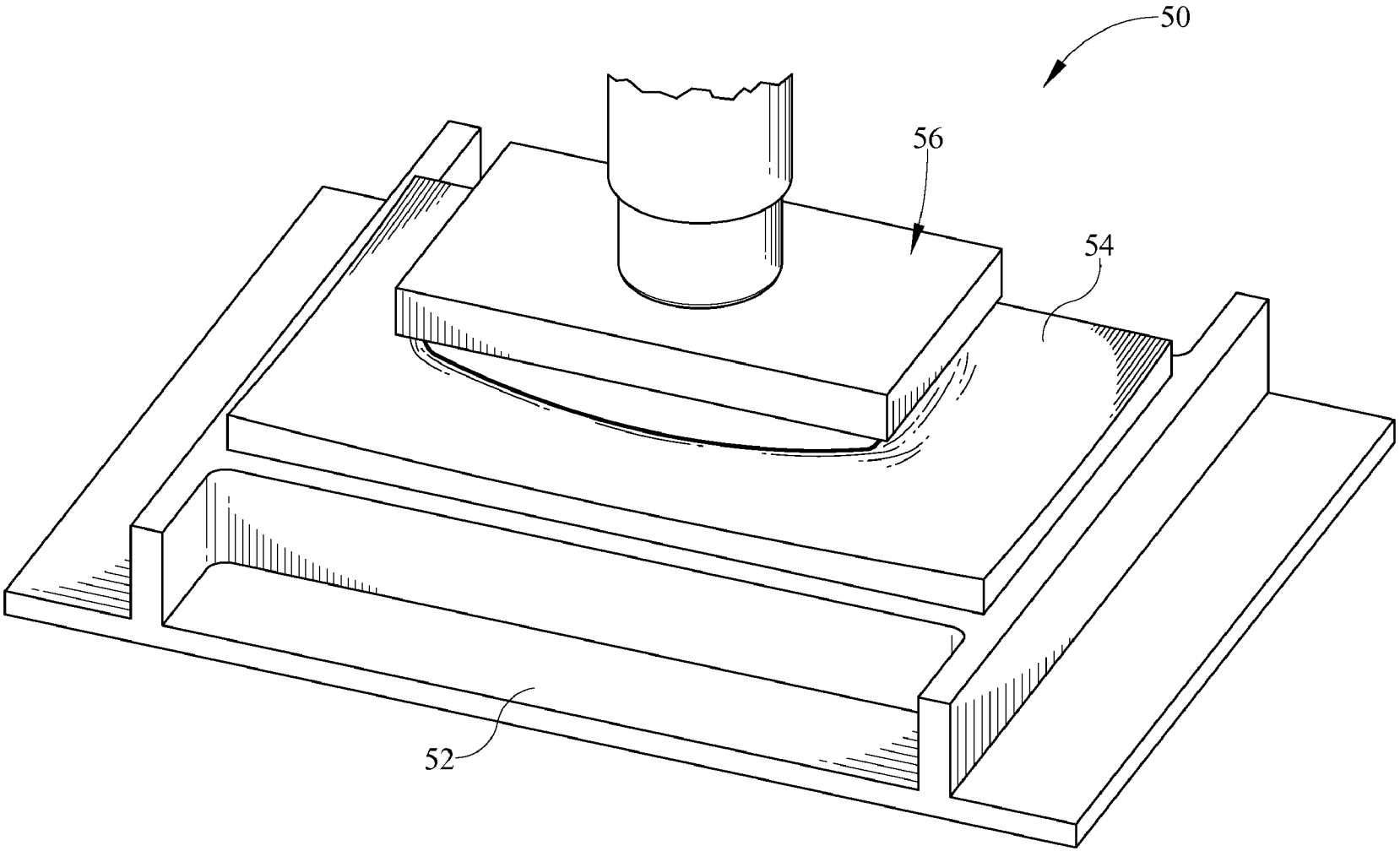
FIG. 11 is a perspective view of an exemplary third process step in the formation of the reflector element.

Referring now to FIG. 11, the tool 56 is continuing to apply downward force to the blank 60'. The softer elastomeric material causes the blank 60' to conform against the tool 56. Additionally, the elastomeric material allows further pressing movement of the tool 56 into the blank 60' than would be allowed with a rigid material behind the blank 60'. This additional movement of the tool 56 into the blank 60' and elastomeric material 54 provides for the formation of the three-dimensionally curved reflector panel 60. Moreover, the three-dimensional bend process is performed in a single hit of the tooling, rather than require bending at each bend line. Thus, the process is more efficient than the prior art since the instant invention allows for formation of the reflector curvature with a single action of the tool rather than multiple actions of a press brake to form the curvature.

Figure 12:
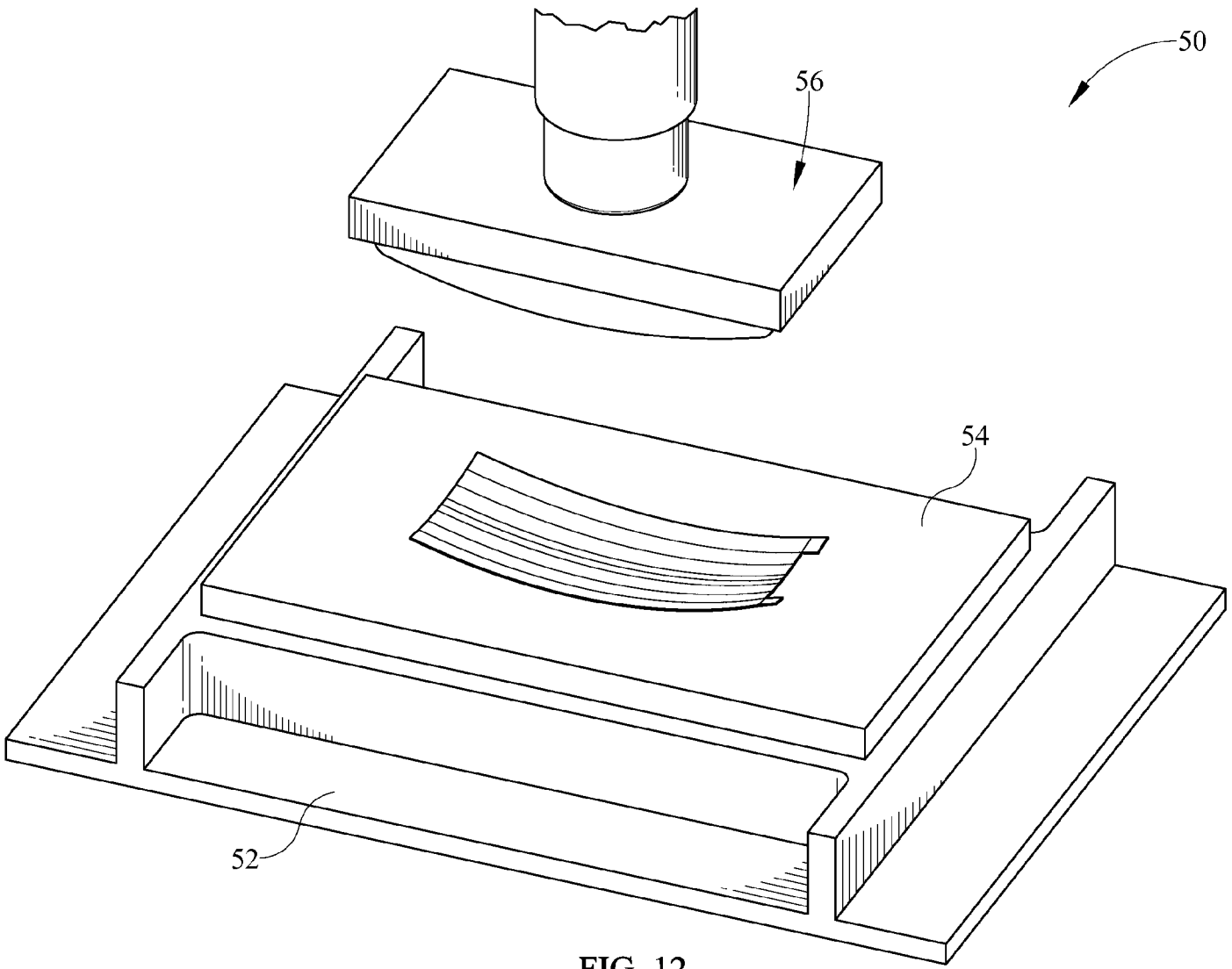
FIG. 12 is a perspective view of an exemplary fourth process step in the formation of the reflector element.

Referring now to FIG. 12, the tool 56 is lifted from the formed reflector panel 60. The panel 60 may additionally be processed to form the flange 68 if necessary. As an alternative, a raw blank, for example raw blank 60" (not shown) may be utilized in the process and after processing by the tool 56, may be cut to a desirable reflector panel shape.

Thus in operation, one of a raw blank or a pre-cut blank is placed on the base 54 having the elastomeric pad 54. Once the blank is properly positioned and oriented, the tool 56 is forced downwardly to engage the blank and begins bending the blank into a three-dimensionally curved reflector panel, for example panel 60. Upon formation of the panel 60, the piece is removed and may be stacked. Due to the three-dimensional curvature, the reflector panel is stronger than a reflector having a two-dimensional curvature. Accordingly, the reflector is stronger and less likely to bend when positioned at the bottom of a stack of reflector panels. Additionally, once the reflector panel 60 is removed from the elastomeric pad 54, a blank may be positioned and oriented for formation.

Figure 13:
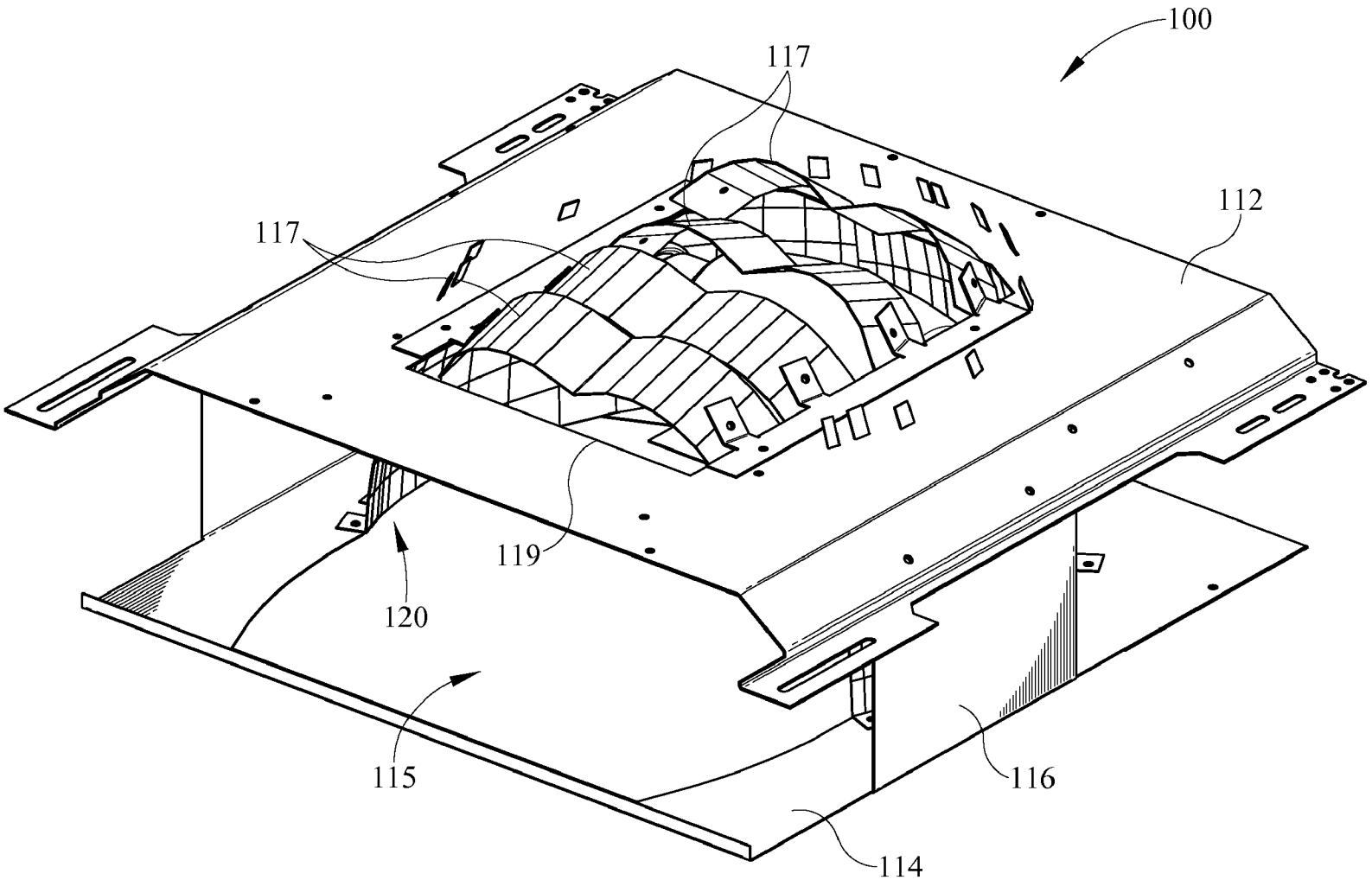
FIG. 13 is an upper perspective view of an alternative luminaire having a reflector assembly formed of a plurality of reflector panels.

Referring now to FIG. 13, an alternative embodiment of a luminaire utilizing the reflector assembly 100 is depicted in perspective view. The reflector assembly 100 includes an upper pan 112 having a central aperture 119 located within the surface defining a structure of the top pan 112. A bottom pan 114 is positioned beneath the top pan 112 and is generally parallel thereto. The bottom pan 114 is separated from the top pan 112 by a strut 116. In the exemplary embodiment two struts are oppositely spaced apart to provide better stability and maintain spacing between the upper and lower pans 112, 114. The bottom pan 114 further comprises a light output aperture 115 through which light passes downwardly into an illuminated area.

Positioned between the top pan 112 and lower pan 114 is a reflector 120. The reflector 120 is three-dimensionally curved and formed in a process wherein the material is stamped and three-dimensionally curved with a single tool in a single action. Thus, the reflector 120 need not be formed by multiple bending processes, but instead formed in a single "hit" of a tool 56 (FIG. 15), as previously described in the methods of forming.

Within the upper opening 119 of the top panel 112, are a plurality of upper reflector segments 117. These reflector segments 117 are curvilinear and direct light downwardly through the light output aperture 115. The upper segments 117 are angled relative to the vertical so as to direct light downwardly to a desired area. The segments 117 therefore may be pivotally adjustable and in accomplishing this task are depicted as being connected by rivets to connection elements 119 on the edge of the aperture 119 in the top pan 112.

Figure 14:
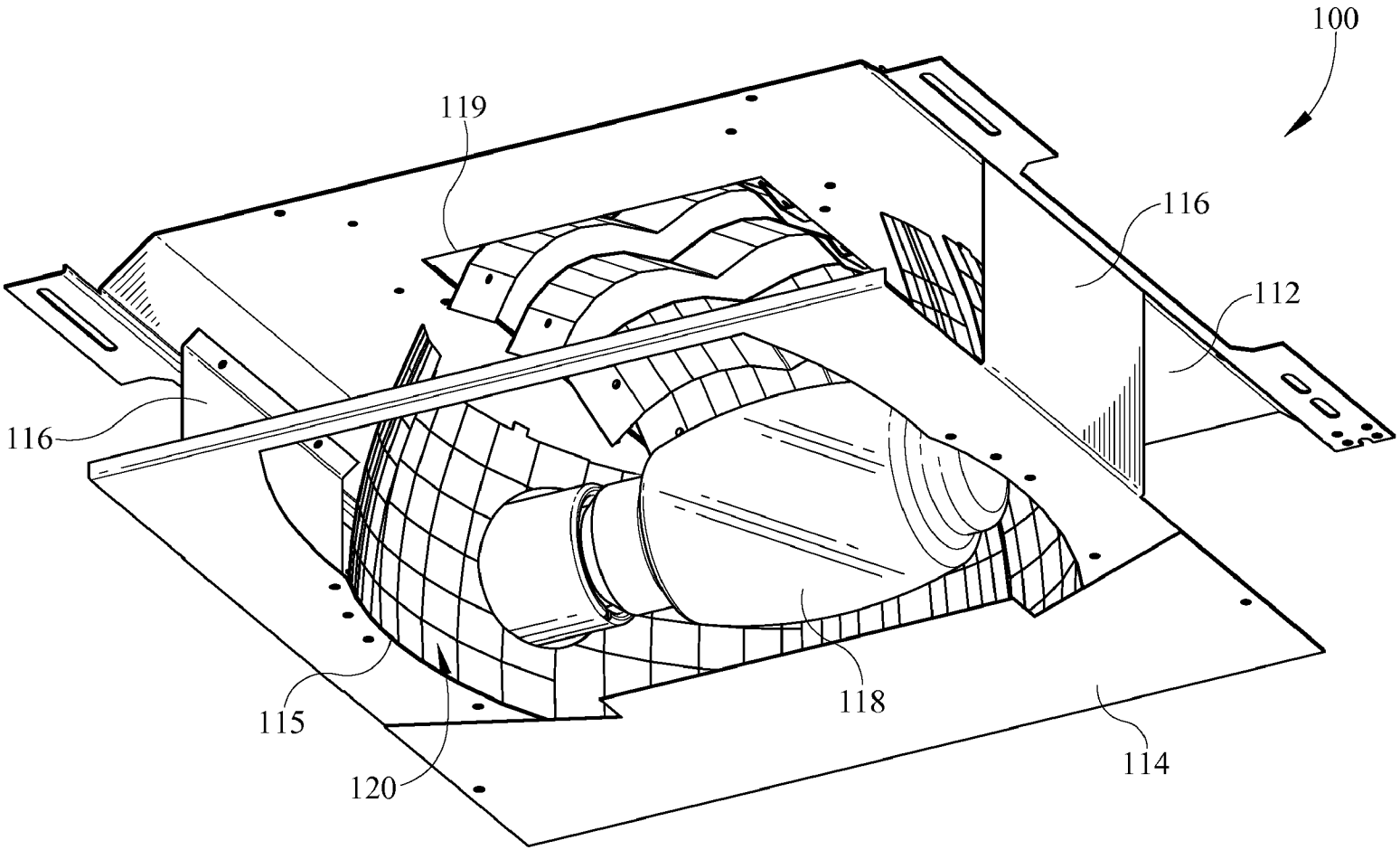
FIG. 14 is a lower perspective view of the alternative luminaire of FIG. 13.

Referring now to FIG. 14, a lower perspective view of the fixture 100 is depicted. As seen viewing upwardly through the light output aperture 115, adjacent the edge of the output aperture 115 are a plurality of reflector panels define the reflector 120. As previously described, the reflector panels defining the reflector 120 are three-dimensionally curved. Specifically, the reflector 120 curves about a vertical plane and about a horizontal plane. The reflector 120 also extends between the bottom pan 114 and the top pan 112. The reflector 120 may also includes an aperture through which a socket passes for positioning of a lamp 118. Thus, it should be clear that the three-dimensionally curved reflector 120 may be utilized in various types of light fixtures by simply varying the size and arrangement of the various panels defining the assembly as a whole. The reflector 120 may be connected to the top and bottom pans 112, 114 by fasteners such as rivets or screws or the like which allow for fixed or pivotable connection.

Figure 15:
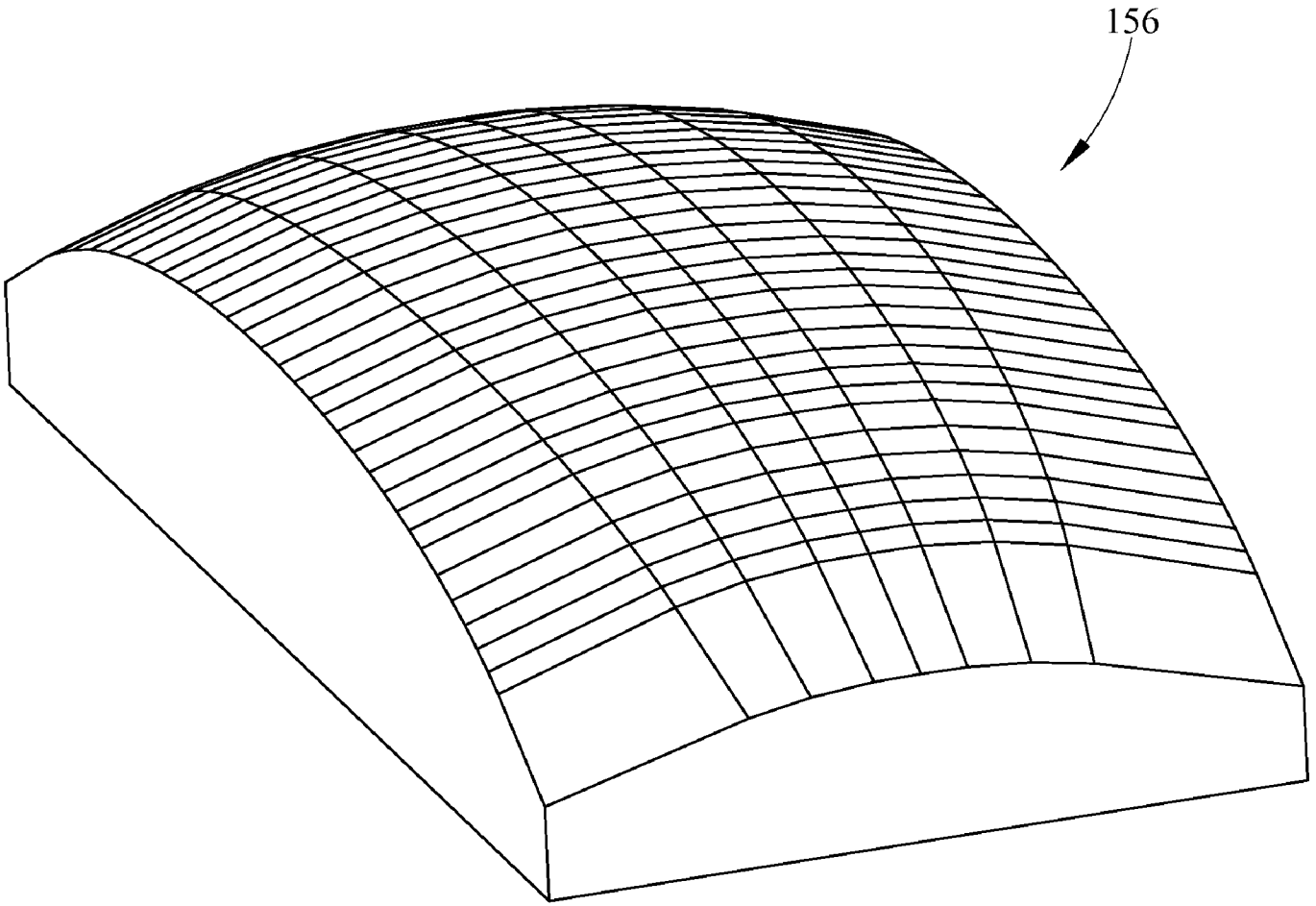
FIG. 15 is a perspective view of a tool used in forming the reflector assembly of FIGS. 13 and 14.

Referring now to FIG. 15, alternative tool 156 is depicted which is utilized to form at least a portion of a panel defining a reflector 120. The tool 156 is curved in three dimensions in order to provide a desired curvature of the various panels defining the reflector 120. The tool may be utilized in a similar manner as previously described, so as to provide a three-dimensionally curved reflector panel with a single "hit" in order to form the panel. Thus, the process is faster than bending each bend line separately with a press break as is currently state of the art in reflector formation.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A luminaire reflector assembly comprising:

a top pan having a light socket connected to one of an upper or lower surface of said top pan;

said top pan having a plurality of spaced slits about the periphery of said top pan;

a lower pan spaced from said top pan, said lower pan connected to said top pan by a plurality of struts, said struts mechanically supporting said top pan from said lower pan and separating said lower pan from said top pan;

a plurality of reflective panels extending between said top pan and said lower pan;

said plurality of reflective panels bent in a first direction by a punch and an elastomeric die pad;

said plurality of reflective panels also bent in a second direction by said punch and elastomeric die pad;

said plurality of reflective panels including a corresponding plurality of corner reflector panels positioned interiorly from said struts; each of corner reflector panels positioned radially each further from a center opening in said lower panel than a plurality of intermediate and a plurality of central reflector panels.

2. The luminaire reflector assembly of claim 1, each of said plurality of reflective panels having at least one tab disposed at an upper end.

3. The luminaire reflector assembly of claim 2 further comprising a flange disposed at a bottom end of said reflective panels.

4. The luminaire reflector assembly of claim 2, said at least one tab extending through said slot of said top pan.

5. The luminaire reflector assembly of claim 2, said flanges engaging said bottom pan.

6. The luminaire reflector assembly of claim 1, said plurality of reflective panels further comprising a tab at a first end and a flange at a second end, said tab engaging one of said top pan and said bottom pan and said flange engaging the other of said top pan and said bottom pan.

7. The luminaire reflector assembly of claim 1, said plurality of reflective panels being free of visible bend lines along an inner surface.

* * * * *